United States Patent [19]

Torrence

[11] Patent Number: 4,793,666

[45] Date of Patent: Dec. 27, 1988

[54] MOTION DISPLAY FOR ARTICLES INSIDE A SHOWCASE

[75] Inventor: Arthur Torrence, Newtown, Conn.

[73] Assignee: Timex Corporation, Middlebury, Conn.

[21] Appl. No.: 137,708

[22] Filed: Dec. 24, 1987

[51] Int. Cl.[4] ..... A47F 3/08

[52] U.S. Cl. ..... 312/134; 312/97

[58] Field of Search ..... 312/134, 97, 268; 211/121; 198/800, 802

[56] References Cited

U.S. PATENT DOCUMENTS

| | | | |
|---|---|---|---|
| 962,933 | 6/1910 | Wallace | 312/134 |
| 1,054,959 | 3/1913 | Anderson | 312/134 |
| 1,299,923 | 4/1931 | Muzyn | 198/800 |
| 2,696,978 | 12/1954 | Siegel | 198/802 X |
| 3,655,031 | 4/1972 | Cahn | 198/800 |
| 3,970,349 | 7/1976 | Banys | 312/134 X |

*Primary Examiner*—Joseph Falk

*Attorney, Agent, or Firm*—William C. Crutcher

[57] ABSTRACT

An improved motion display for articles inside a showcase comprises a base member having longitudinally spaced walls, and a moving set of shelves each having receptacles for articles to be displayed. A continuous loop chain conveyor traverses the walls in a substantially rectangular pattern. Stationary guide rails cooperate with the shelves to periodically pivot or rotate them into various orientations as they travel. A photoelectric sensor stops the travel of the shelves when a customer interrupts light striking the sensor.

10 Claims, 4 Drawing Sheets

MOTION DISPLAY FOR ARTICLES INSIDE A SHOWCASE

BACKGROUND OF THE INVENTION

This invention relates generally to motion display apparatus of the type used to display watches or similar articles. Retail stores and similar establishments display articles to customers for selection and purchase. Motion displays are known which have the advantage of attracting the attention of customers by the movement of the articles and also which are capable of displaying a larger number of articles from various angles. In the case of valuable articles, it is also desired to have security against theft by enclosing the display shelf or articles inside a showcase. Difficulties are thereby encountered in removing an article from the display for closer examination by customer. A showcase has a minimum amount of space available and, therefore, the machinery, motor and supports required for a motion display have militated against placing motion displays inside a showcase. This leads to the use of free standing units which take up additional floor space. Motion displays have also had a disadvantage in continuing to move or rotate without the ability for a customer to stop the motion for closer scrutiny of the displayed article.

Motion displays are known which employ hanging shelves for articles to be displayed, where the shelves always hang in the same orientation, much as the seats on a ferris wheel, whereby the shelves translate in a circular direction without rotation. This requires greater vertical space than is often available in a showcase.

Accordingly, one object of the present invention is to provide an improved motion display for displaying articles inside a showcase in a minimum space.

Another object of the invention is to provide an improved motion display for viewing articles inside a showcase, stopping the motion from outside the showcase, and allowing ease of accessibility to the articles for removal.

Still another object of the invention is to provide an improved mechanism for displaying shelves of articles in first and second viewing orientations as they travel horizontally and vertically inside a showcase.

Other objects and advantages of the invention will become apparent from the following description, taken in connection with the accompanying drawings, in which.

Figure 1:
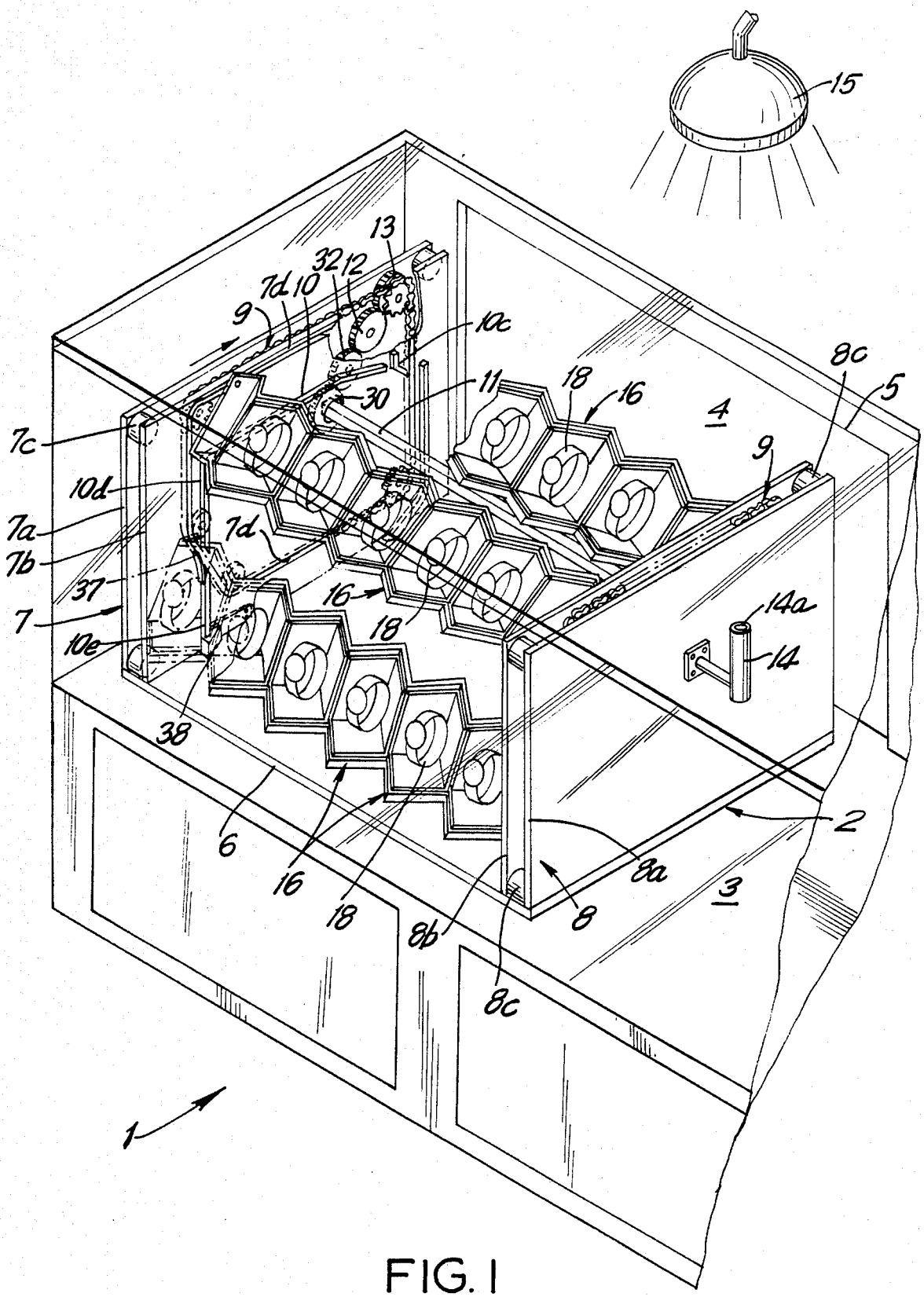
FIG. 1 is a perspective view of a portion of a showcase with the motion display inside.
Figure 4:
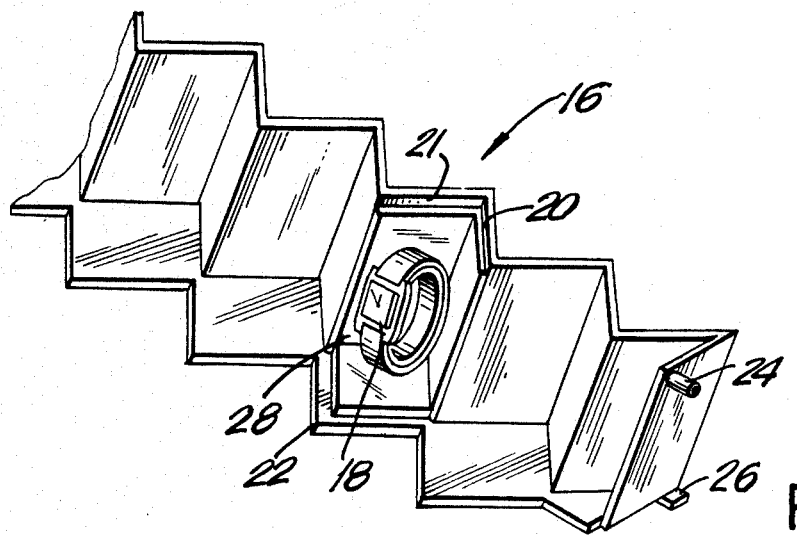
Figure 5:
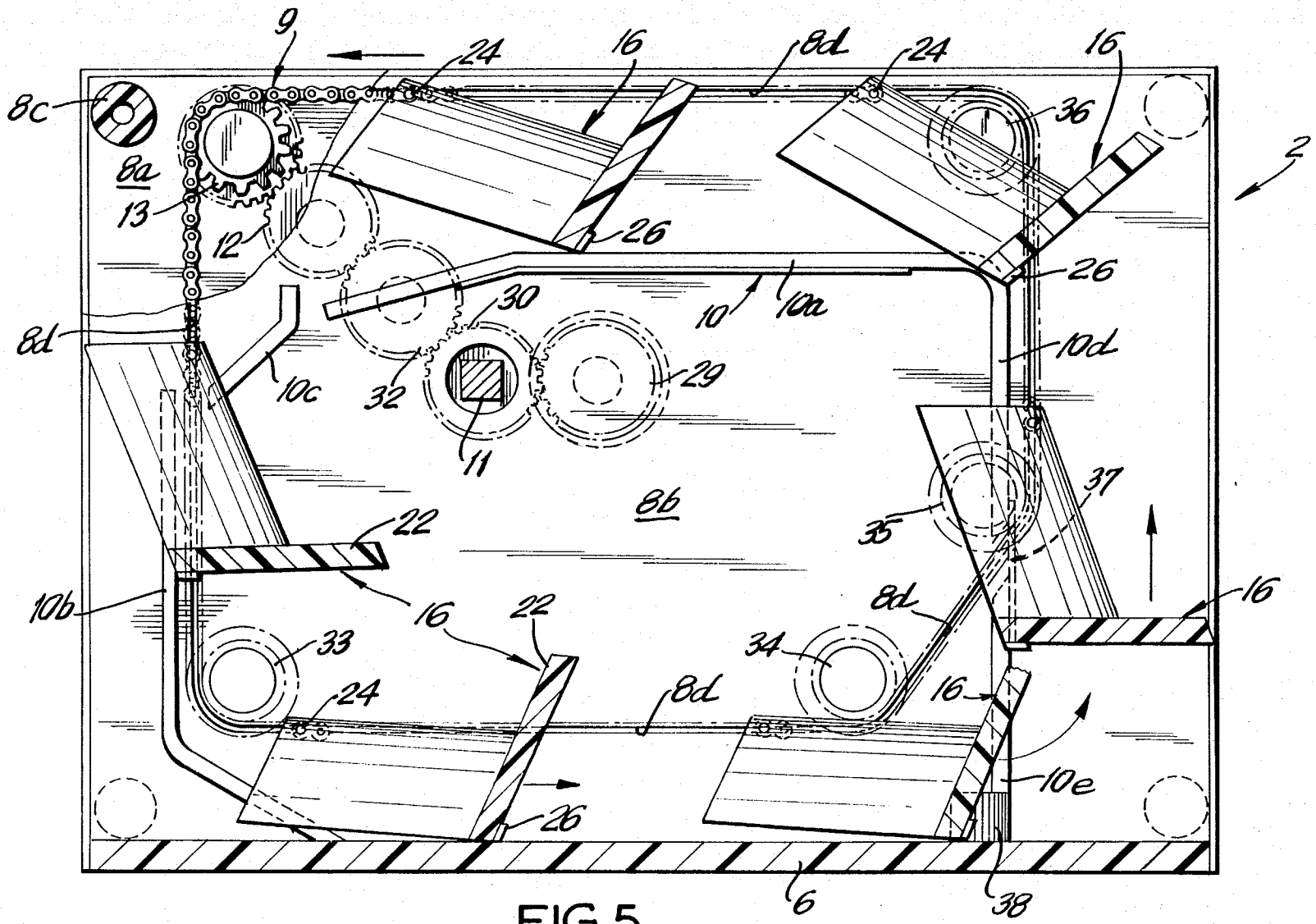
Figure 6:
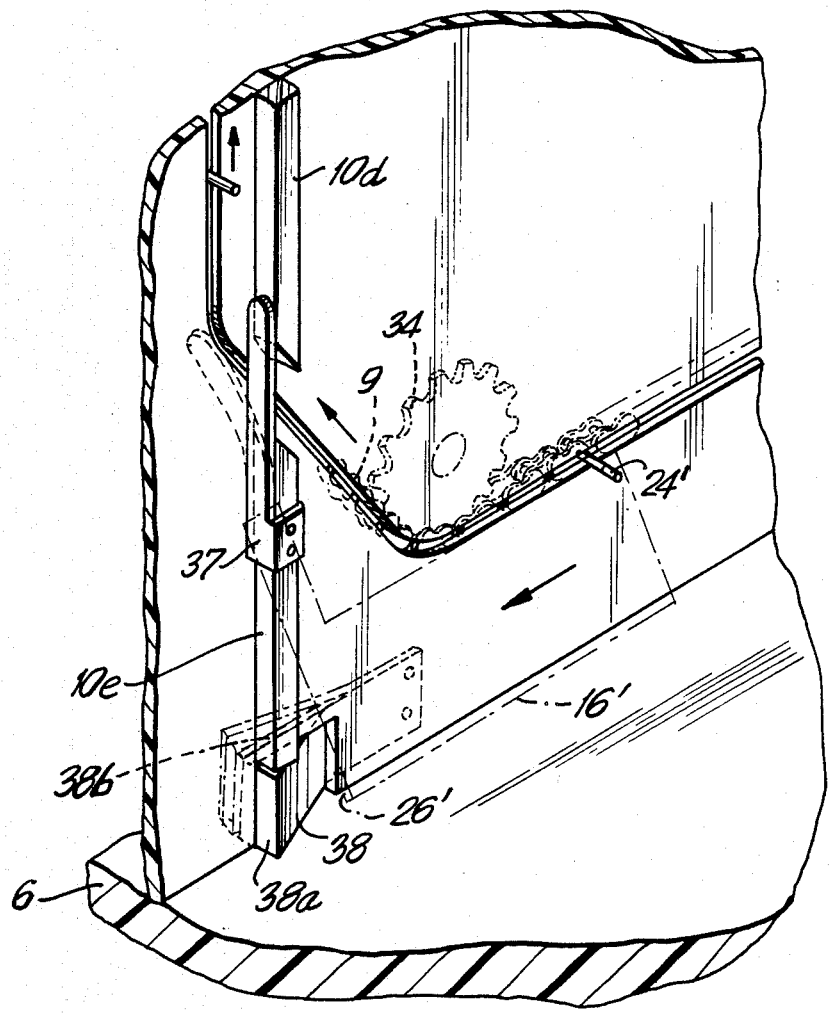

FIG. 4 is a perspective view of a portion of a longitudinal shelf with receptacles, having a watch box to be displayed in one of its receptacles, FIG. 5 is an elevation view partly in section, looking from the inside of the motion display of FIG. 1 toward the right-hand wall, and FIG. 6 is a schematic perspective view showing details of the guide rail gates which facilitate transport and orientation of the shelves.

SUMMARY OF THE INVENTION

Briefly stated, the invention comprises an improved motion display for articles inside a showcase comprising a frame having longitudinally spaced walls, a plurality of longitudinal shelves each having a plurality of receptacles for articles to be displayed, continuous loop conveyor means arranged to traverse the walls in a substantially rectangular pattern, the longitudinal shelves having pivots arranged to hang the shelves in spaced relationship along the conveyor means, and stationary guide rails adapted to cooperate with the shelves to periodically pivot or rotate them into various orientations as they travel. In accordance with one aspect of the invention, control means such as a photoelectric sensor may be arranged to interrupt the travel of the shelves from outside the showcase.

DESCRIPTION OF THE PREFERRED EMBODIMENT

Referring now to FIG. 1 of the drawing, a showcase counter unit shown generally as 1 includes a substantially rectangular enclosure partially enclosed by transparent glass front 3 and transparent glass countertop 4. The showcase enclosure contains a motion display shown generally as 2 and is secure to protect the articles being displayed and is accessible only from the rear through a locked door 5. The motion display 2 comprises a frame having a base member 6 and a pair of longitudinally spaced wall members shown generally as 7 and 8. Base member 6 is a flat rectangular piece supporting and spacing the walls 7 and 8. Alternatively it could be a large tubular member extending between and serving to space the walls, or could be formed of a series of connecting rods or tubes.

Each of the wall member 7, 8 is of hollow double wall construction, comprised of two sheets *7a, 7b* and *8a, 8b* separated by spacers *7c* and *8c* respectively. Disposed inside each of the wall members 7, 8 is a continuous loop conveyor means such as roller chain 9. Other types of continuous loop conveyor means might be a plastic cog belt or an elastomeric belt molded in sections, the exact type not being material to the present invention. A slot *7d* in inner wall sheet *7b* follows the chain pattern. It and a similar slot *8d* in the opposite inner wall sheet *8b* will be described later in further detail. Projecting from inner wall sheet *7b* is a guide rail 10 which also will be described later in further detail. A similar arrangement of chain 9 and guide rail 10 is arranged in mirror image on wall 8 together with a motor (FIG. 5). The motor drives a shaft 11 extending longitudinally across the space between walls 7, 8. Shaft 11 slowly moves the conveyor chain 9 through a series of idler gears such as 12 turning a chain sprocket 13.

A photoelectric sensor 14 with adjustable sensitivity serves as control means to interrupt the motor from outside the showcase. Sensor 14 is connected to operate an electronic switch connected in series with the drive motor, so as to interrup the motor and to stop chain 9 in the absence of light striking the end *14a* of sensor 14. Sensor 14 is directed through transparent glass countertop 4 toward a source of ambient light such as overhead light 15.

Disposed between longitudinally spaced walls 7 and 8 are a number of longitudinal shelves 16. Shelf 16 is shown oriented in a first or vertical orientation at the front of the display and is shown in a horizontal or second orientation along the top of the display. The shelves contain articles to be displayed such as boxes containing watches 18.

Figure 2:
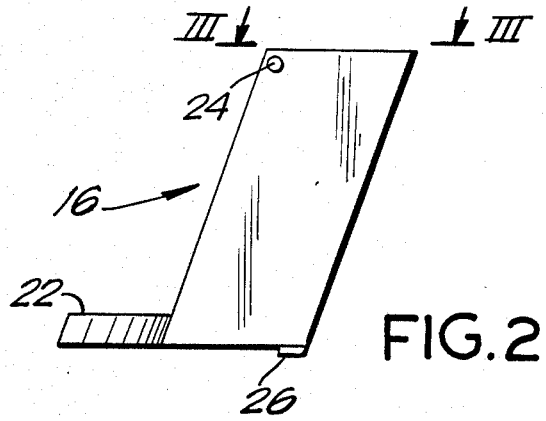
FIG. 2 is a horizontal elevation view of a longitudinal shelf for articles to be displayed.
Figure 3:
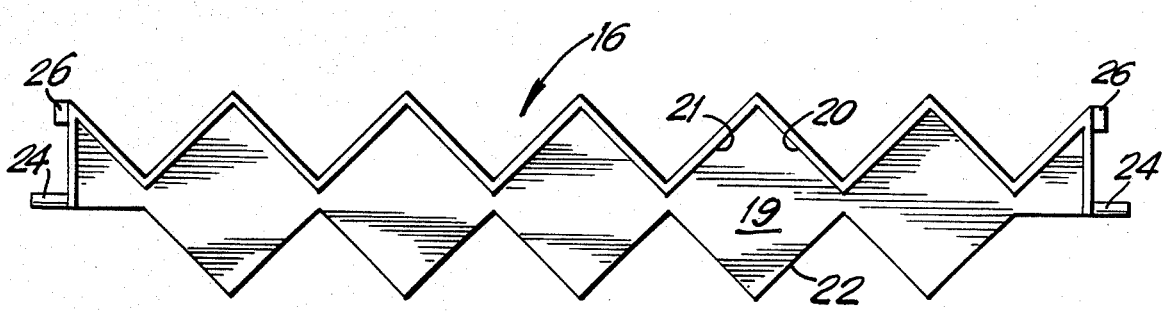
FIG. 3 is a view looking in the direction of arrows III—III of FIG. 2.

Reference to FIGS. 2, 3, and 4 of the drawing show various views of one of the longitudinal shelves 16. Each shelf 16 depicted in FIGS. 2, 3, and 4 contains a plurality of open receptacles 19 formed by intersecting walls 20, 21, and base 22, although the shape of the receptacles is not a material part of the present invention. Each shelf further is provided with opposed pivot pins 24 at its top and opposed guide shoes 26 at its bottom. Shoes 26 are simple tabs, although rollers could be substituted to reduce wear. Articles to be displayed are loosely placed in the receptacles 19, as indicated by a watch box 28 containing a watch 18 in FIG. 4.

The particular size and shape of the article being displayed is immaterial, except that the invention operates to its best advantage when the article is in a box which exposes the article from several sides so that it can be displayed from various directions. A suitable box for this motion display is shown in U.S. Pat. No. Des. 291,867 issued Sept. 15, 1987 and assigned to Timex Corporation.

Referring now to FIG. 5 of the drawing, an elevation view is shown of the wall member 8 from inside the motion display, and looking toward the inner wall sheet member **8*b*. A portion of sheet 8*b* is broken away to illustrate that outer wall 8*a* is spaced from it by a spacer 8*c* in order to allow room for roller chain 9 idler 12 and sprocket 13, these being substantially identical to chain, idler gear and sprocket 9, 12 and 13 respectively between wall sheet members 7*a*, 7*b* (FIG. 1). A geared down electric motor 29 slowly turns sprocket 13 and idler gear 12 through intermediate idler gears 30 and 32 to turn chain 9 in the direction indicated by the arrow. Chain 9 is a continuous loop passing over round chain guide spacers 33, 34, 35, and 36 located to cause the chain to traverse wall member 8 in a substantially rectangular pattern. The chain guide spacers 33, 34, 35, and 36 are not rotatable in the embodiment shown, and the roller chain 9 simply slides over them. Therefore, they can also serve to support and space the wall portion inside of the slot 8*d*. Obviously, rollers or sprockets could be substituted for guide spacers 33–36** and the axle used to space the inner and outer wall sheets.

Pivot pins 24 of longitudinal shelf 16 are pivotally connected to chains 9 in opposed walls 7 and 8 by passing through the slots **7*d* and 8*d* which are formed adjacent the chain 9 in the inner wall sheets 7*b*, 8*b*. In this manner shelf 16 hangs in a first or substantially vertical orientation from opposed pivot pins 24. Therefore, the chain 9 serves as a conveyor means for shelves 16. Pivot pins 24 are spaced along the continuous loop chain 9 so as to support several shelves 16** and to move the shelves transversely in a continuous loop.

In order to rotate or pivot the shelves into other orientations during their travel, guide rails 10 are provided. Guide rails 10 project from the opposed inner side walls sheets **7*b*, 8*b* and cooperate with guide shoes 26 to cause the shelves to pivot about pivot pins 24 into various orientations, depending upon the location of the pivot pin, the guide shoe and the preselected location of the guide rail. Guide rails 10 are formed in mirror image on the opposite side wall 7** (See FIG. 1).

The guide rails 10 comprise a horizontal portion **10*a*, a rear vertical portion 10*b* with a separated transition portion 10*c* therebetween, a vertical front upper portion 10*d* and a front vertical lower portion 10*e*. The base member 6** of the display serves in lieu of a lower horizontal guide rail.

Disposed between front vertical portions **10*d*, 10*e* is a first spring loaded one way gate 37. Disposed between front vertical lower portion 10*e* and base 6 is a second spring loaded gate 38**.

Referring now to FIG. 6 of the drawing, the fragmentary perspective drawing illustrates purpose and operation of gates 37 and 38. First gate 37 is a spring metal clip attached to front vertical lower portion **10*e* and spring biased against the front vertical upper portion 10*d* to close the opening between them, but to permit the pivot connection between chain 9** and the longitudinal shelf to pass through the guide rail.

The second gate 38 comprises a wedge member **38*a* attached to a leaf spring 38*b*. This allows the guide shoe 26 of the longitudinal shelf to pass between guide rail 10*e* and base 6. The projected outline of the shelf is indicated by phantom line 16', its pivot connection by the reference 24' and its guide shoe by reference number 26'**.

OPERATION

Operation of the shelf moving mechanism is best understood by reference to FIG. 5. Motor 29 rotates the idler gears 12, 30, 32 in wall 8 and in the opposed longitudinally spaced wall 7 by means of shaft 11 extending between the walls. Therefore, both of the roller chains 9 are moved in synchronism to convey the spaced pivot connections 24 supporting the longitudinal shelves 16 between them. When shelves 16 are traveling vertically, they are rotated and held in a first vertical orientation by the guide shoes 26 riding against vertical wall portions **10*b*, 10*d*, and 10*e***.

As the shelves 16 travel to the left in FIG. 5 (across the top of the display), the shelves are caused to pivot into a second horizontal orientation by means of guide shoes 26 traveling along and supported by the horizontal guide rail portion **10*a***.

When the shelves move to the right in FIG. 5 (along the bottom of the display, shelves 16 are pivoted into still a third, but still substantially horizontal configuration by pivoting on pins 24 with guide shoes 26 sliding across base 6. As they reach the lower right-hand corner in FIG. 5, guide shoes 26 depress the spring loaded, wedge shaped gates 38 out of the way. Similarly, the pivot pins 24 which are traveling in the slots **8*d* pass between the guide rail vertical portions 10*d*, 10*e* and through spring loaded gate 37. As shelf 16 is moved vertically, it is pivoted to the first orientation again by the shoes 26, which can not pass back through the spring loaded gates 37, 38**.

At the upper left-hand corner of the display shown in FIG. 5, it will be seen that the pivot connections 24 can move along the wall slot **8*d* around the sprocket 13 and that the guide shoe 26 can move between the wall portions 10*a*, 10*c***. In both of the first, second, and third orientations of the longitudinal shelf, the open receptacles displaying articles are arranged so that they will not dump the article out in any of these orientations of the shelves. At the rear of the display, therefore, on the left-hand side of FIG. 5, the article can be easily reached through the showcase door and removed from the receptacle in the shelf.

Referring to FIG. 1 of the drawing, the motion display continuously causes the longitudinal shelves to move transversely in a substantially rectangular pattern, while the guide rails 10 cooperate with the guide shoes 26 to periodically reorient the shelves to occupy a minimum of space and to display the articles from at least two different angles through the showcase glass walls 3, 4. Should a customer decide to stop the display for viewing an article, it is only necessary to place a hand or other opaque object between photoelectric sensor 14 and the lamp 15. This may be done without opening the showcase since the light to keep the display operating comes from outside of the showcase from light source 15. Extinguishing light source 15 at night stops the display automatically.

The sensor described is only one type which may be used to interrupt the motor from outside the showcase. An infrared sensor may be substituted with switch to stop the motion in the presence of heat. A simple manual switch or push button outside the showcase may also be used, although this would require additional wiring.

While there has been described what is considered to be the preferred embodiment of the invention, other modifications will occur to those skilled in the art, and it is desired to secure in the appended claims all such modifications as fall within the true spirit and scope of the invention.

I claim:

1. A motion display for articles inside a showcase comprising:

a frame having opposed longitudinally spaced wall members, a plurality of longitudinal shelves each shelf having a plurality of receptacles for articles to be displayed, conveyor means for causing said shelves to move transversely between said walls in a continuous loop defining a first substantially vertical part at the front of said display and a second substantially horizontal part along the top of said display, a motor driving said conveyor means, opposed pivot means on opposite ends of said shelves, said shelves being spaced around said continuous loop and supported by said pivot means, and guide rail means cooperating with said shelves to cause them to periodically pivot around said pivot means into a first orientation over said first part of said continuous loop and into a second orientation over said second part of said continuous loop.

2. The combination according to claim 1, and further including control means responsive to signals from outside said showcase and connected to control operation of said motor to stop said conveyor means.

3. The combination according to claim 2, wherein said control means includes a photoelectric sensor connected to said motor and arranged to cause said motor to be actuated only when said sensor is illuminated.

4. The combination according to claim 1, wherein said guide rail means comprises rails projecting from said wall members, and wherein said shelves have opposed guide shoes riding on said rails to cause periodic reorientation of said shelves.

5. The combination according to claim 4, and further including at least one spring biased one way gate defined between portions of said projecting rails and adapted to allow passage of said pivot means and said guide shoes.

6. The combination according to claim 1, wherein the continuous loop of said conveyor means comprises a roller chain disposed in each of said opposed wall members and traverses a substantially rectangular vertical and horizontal pattern, and means cooperating with said guide rail means to cause said shelves to change from said first orientation to said second orientation when said roller chain changes from vertical to horizontal travel.

7. A motion display for articles inside a showcase comprising:

a plurality of longitudinal shelves, each shelf having a plurality of receptacles for articles to be displayed, a frame comprising a base member and first and second opposed longitudinally spaced wall members, first and second continuous loop conveyor means arranged to transverse said first and second wall members vertically and horizontally in substantially rectangular patterns, a motor connected to drive said first and second conveyor means, first and second guide rail means disposed along and projecting from said first and second wall members respectively, each said longitudinal shelf having opposed pivot members connected to be transported by said first and second conveyor means, said pivot members being spaced along said conveyor means to carry a plurality of shelves, each longitudinal shelf having opposed guide shoes cooperating with said guide rail means to cause the shelves to pivot into a first orientation at the front of said display over a vertical portion of travel and to pivot into a second orientation along the top of said display over a horizontal portion of travel, whereby said articles are displayed when the shelves travel in both said first and second orientations.

8. The combination according to claim 7, including a photoelectric sensor connected to said motor and arranged to cause said motor to be actuated only when said sensor is illuminated.

9. The combination according to claim 7, wherein each of said wall members are hollow and wherein said first and second conveyor means are arranged to travel inside said first and second wall members respectively.

10. The combination according to claim 9, wherein said guide rail means include a first spring loaded gate adapted to permit passage of said pivot means and wherein said guide rail means include a second spring loaded gate adapted to provide passage of said guide shoes.

* * * * *